US010627056B2

(12) United States Patent
Sharrah

(10) Patent No.: US 10,627,056 B2
(45) Date of Patent: Apr. 21, 2020

(54) HELMET LIGHT

(71) Applicant: Streamlight, Inc., Eagleville, PA (US)

(72) Inventor: Raymond L. Sharrah, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 46 days.

(21) Appl. No.: 15/899,133

(22) Filed: Feb. 19, 2018

(65) Prior Publication Data

US 2018/0195676 A1 Jul. 12, 2018

Related U.S. Application Data

(63) Continuation of application No. 12/356,364, filed on Jan. 20, 2009, now abandoned.

(51) Int. Cl.

| | |
|---|---|
| ***F21V 21/088*** | (2006.01) |
| ***F21V 15/01*** | (2006.01) |
| ***F21Y 115/10*** | (2016.01) |
| ***F21Y 113/00*** | (2016.01) |
| ***F21L 4/08*** | (2006.01) |
| ***F21L 4/02*** | (2006.01) |
| ***F21V 23/04*** | (2006.01) |
| *F21V 31/00* | (2006.01) |

(52) U.S. Cl.

CPC ..... *F21L 4/025* (2013.01); *F21V 15/01* (2013.01); *F21V 21/0885* (2013.01); *F21V 23/0414* (2013.01); *F21L 4/08* (2013.01); *F21V 31/00* (2013.01); *F21Y 2113/00* (2013.01); *F21Y 2115/10* (2016.08)

(58) Field of Classification Search

CPC .. F21L 4/025; F21L 4/08; F21V 15/01; F21V 21/0885; F21V 23/0414; F21V 31/00; F21Y 2113/00; F21Y 2115/10

See application file for complete search history.

(56) References Cited

U.S. PATENT DOCUMENTS

| | | | |
|---|---|---|---|
| 1,203,576 | A | 11/1916 | Broadhead |
| 1,645,487 | A | 10/1927 | Harling |
| 1,671,744 | A | 5/1928 | Rosenberg |
| 1,816,065 | A | 7/1931 | Weidman |
| 2,716,700 | A | 8/1955 | La France |
| 3,003,057 | A | 10/1961 | Cheng |
| 4,045,663 | A | 8/1977 | Young |
| 4,135,230 | A | 1/1979 | Armbruster |
| 5,067,058 | A | 11/1991 | Standley |
| D353,055 | S | 12/1994 | Kish et al. |
| 5,658,065 | A | 8/1997 | Jamieson |
| 5,755,644 | A | 5/1998 | Breems |
| 5,800,045 | A | 9/1998 | Kish et al. |

(Continued)

OTHER PUBLICATIONS

Webster's II New College Dictionary, published 1995, Houghton Mifflin Co. p. 559.

(Continued)

*Primary Examiner* — Tsion Tumebo

(74) *Attorney, Agent, or Firm* — Niels Haun; Dann, Dorfman, Herrell & Skillman

(57) ABSTRACT

A flashlight for mounting on a helmet is provided. The flashlight includes a mount that is configured to be readily attachable to the brim of a variety of helmets. The flashlight includes a forward-facing light to provide illumination and a rearward facing light for identifying the user.

24 Claims, 9 Drawing Sheets

(56) References Cited

U.S. PATENT DOCUMENTS

| | | | | |
|---|---|---|---|---|
| 5,871,272 | A | 2/1999 | Sharrah et al. | |
| 6,015,217 | A | 1/2000 | Colangelo et al. | |
| 6,099,141 | A | 8/2000 | Landamia | |
| 6,158,874 | A | 12/2000 | Brustein et al. | |
| 6,168,288 | B1 | 1/2001 | St. Claire | |
| 6,206,543 | B1 | 3/2001 | Henry | |
| 6,302,570 | B1 | 10/2001 | Petell et al. | |
| 6,305,818 | B1 | 10/2001 | Lebens et al. | |
| 6,318,879 | B1 | 11/2001 | Huang | |
| 6,331,062 | B1 | 12/2001 | Sinclair | |
| 6,439,733 | B1 | 8/2002 | Fischer et al. | |
| 6,450,659 | B1 | 9/2002 | Salatino | |
| 6,523,972 | B2 | 2/2003 | Sharrah et al. | |
| 6,565,241 | B1 | 5/2003 | Glynn | |
| 6,612,714 | B1 | 9/2003 | Morre et al. | |
| 6,616,294 | B1 | 9/2003 | Henry | |
| 6,623,140 | B2 | 9/2003 | Watterson et al. | |
| 6,641,279 | B1 | 11/2003 | Williams | |
| 6,722,770 | B2 | 4/2004 | Colangelo | |
| 6,834,976 | B2 | 12/2004 | Galli | |
| 6,857,756 | B2 | 2/2005 | Reiff et al. | |
| 7,059,744 | B2 | 6/2006 | Sharrah | |
| 7,066,621 | B2 | 6/2006 | Booty | |
| 7,111,965 | B2 | 9/2006 | Hsu | |
| 7,156,536 | B1 | 1/2007 | McCorkle | |
| 7,178,933 | B1 | 2/2007 | Chuang | |
| RE40,342 | E | 5/2008 | Krieger | |
| 7,481,551 | B2 | 1/2009 | Sharrah | |
| 7,661,858 | B2 * | 2/2010 | Chuang | B62J 6/02 362/191 |
| 7,677,755 | B2 | 3/2010 | Kim | |
| 7,722,205 | B2 | 5/2010 | Kim | |
| 2006/0028812 | A1 | 2/2006 | Yuen | |
| 2006/0120066 | A1 | 6/2006 | Huang | |
| 2007/0025101 | A1 | 2/2007 | Lawless | |
| 2010/0301779 | A1 * | 12/2010 | Spartano | H01M 10/44 315/320 |

OTHER PUBLICATIONS

The "10 Mile Light", Bright Star Product Brochure published before Nov. 7, 2003, 2 pages.

LiteBox, sold prior to Nov. 2003.

Streamlight 4AA Helmet Light: photographs and product label; sold before Jan. 20, 2009.

Streamlight Firefighter's Helmet Flashlight Clamp Kit: 2 photographs and package insert; sold before Jan. 20, 2009.

Streamlight Helmet Clamp, Product # 70109: 2 photographs and label; sold before Jan. 20, 2009.

Streamlight Euro Helmet Mount, Product # 68120: 2 photographs and label; sold before Jan. 20, 2009.

Streamlight Helmet Clamp, Product # 67004: 2 photographs and label; sold before Jan. 20, 2009.

Streamlight Helmet Clamp, Product # 67005: 2 photographs and label; sold before Jan. 20, 2009.

Streamlight Helmet Clamp, Product # 67006: 2 photographs and label; sold before Jan. 20, 2009.

Streamlight Helmet Clamp, Product # 68004: 2 photographs and label; sold before Jan. 20, 2009.

Streamlight Helmet Mount, Product # 68130: 2 photographs and label; sold before Jan. 20, 2009.

Streamlight Helmet Clamp, Product # 70108: 2 photographs and label; sold before Jan. 20, 2009.

Streamlight Helmet Clamp, Product # 70110: 2 photographs and label; sold before Jan. 20, 2009.

Streamlight Helmet Clamp, Product # 68005: 2 photographs and label; sold before Jan. 20, 2009.

Streamlight Helmet Clamp, Product # 68006: 2 photographs and label; sold before Jan. 20, 2009.

* cited by examiner

HELMET LIGHT

PRIORITY CLAIM

This application is a Continuation of co-pending U.S. patent application Ser. No. 12/356,364 filed Jan. 20, 2009. The entire disclosure of the foregoing application is hereby incorporated herein by reference.

FIELD OF THE INVENTION

The present invention relates to the field of portable lights, and more specifically relates to portable lights to be mounted on the user's head. In particular, the present invention relates to a portable light configured to be mounted onto a helmet.

BACKGROUND

A headlamp is a portable light that allows the user to illuminate an area without the need to hold the light. Since the light is mounted on the user's head, the user is free to use his or her hands for the task at hand. One common type of headlamp is a portable light having one or more straps for mounting the light on the user's head.

One particular field that a headlamp could be particularly useful is the field of emergency services, including firefighters and rescue personnel. However, emergency personnel wear safety helmets that often make the use of a strap mounted light difficult or impractical. Further still, the helmets used by emergency personnel vary significantly in shape and size. Additionally, safety codes preclude connections that would alter the physical characteristics of a helmet. For instance, a mounting element that would require a hole to be drilled into the helmet could require recertification for each helmet onto which the flashlight would be mounted. Obviously, it would be cost prohibitive to perform such re-certification for all of the various different helmets used by emergency personnel.

Many solutions have been proposed for mounting a flashlight onto helmets, however, the known solutions suffer from one or more substantial drawbacks. For instance, some of the known mounting elements are operable with some known helmets, but are limited to a few basic helmet designs. Other mounting elements are complicated and do not rigidly mount the light in a fixed orientation. Other lights fix the orientation of the light, but do not allow the beam to be adjusted for a particular helmet and/or user. Additionally, the known mounting elements are add-on units that are connected to the helmet by the user, and then connected to the light.

SUMMARY OF THE INVENTION

Accordingly, there is a long-felt need for a flashlight with an integrated mounting element for mounting a flashlight onto a helmet in such a way that substantially rigidly fixes the orientation of the light beam while allowing the user to re-orient the light beam as necessary for the particular helmet. Therefore, the present invention provides a flashlight having a housing with a mounting element connected with the housing. The mounting element is configured to releasably connect the light onto the brim of a helmet. To allow the light to be attached to a variety of brims, the mounting element includes a lock that is variable between an upper limit and a lower limit for locking onto the brim. Additionally, the light may include an adjustment element for adjusting the angle of the light relative to the brim.

According to one aspect, the mount is connected with the housing so that a drag force is created between the housing and the mount, which impedes rotation of the mount relative to the housing.

DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

Figure 1:
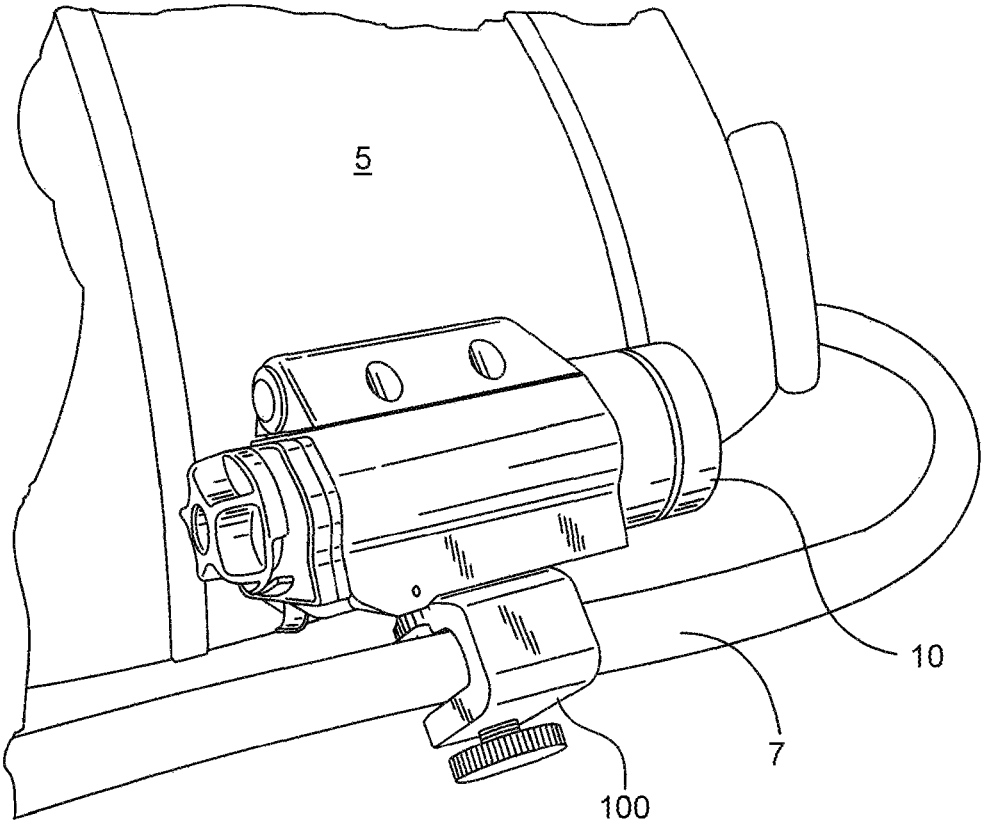
FIG. 1 is a perspective view of a helmet light mounted onto a helmet above the brim of the helmet.
Figure 2:
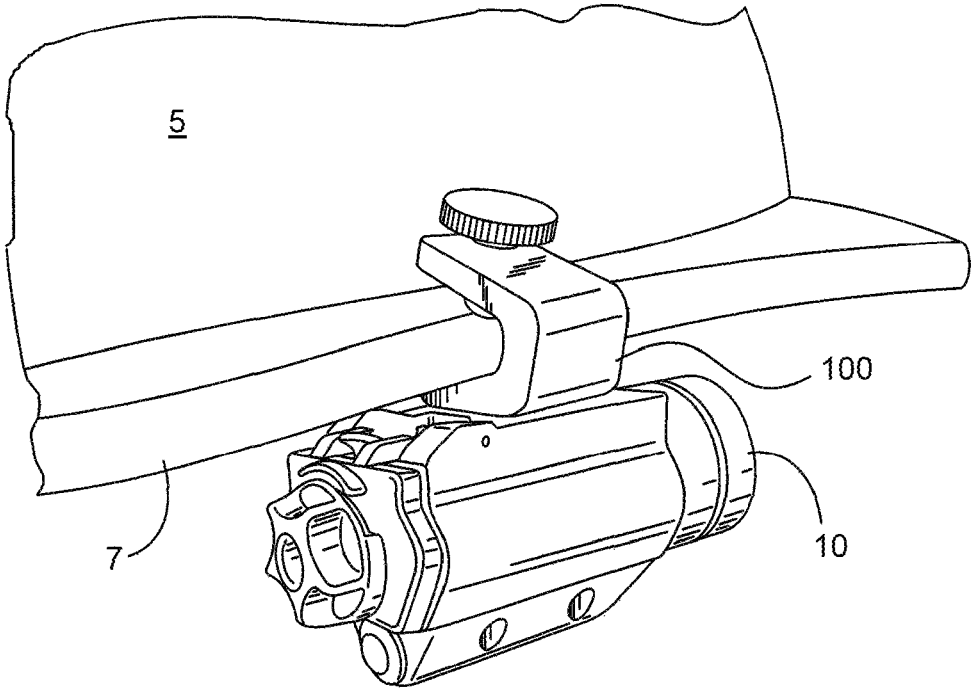
FIG. 2 is a perspective view of the helmet light of FIG. 1 mounted onto a helmet below the brim of the helmet.
Figure 3:
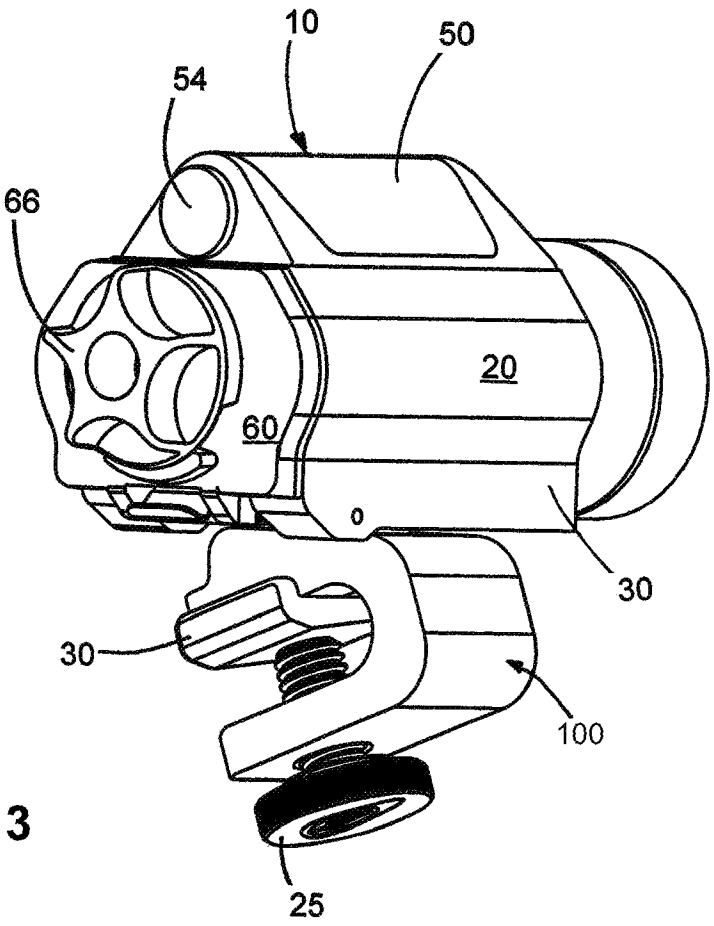
FIG. 3 is a perspective view of the helmet light of FIG. 1.

Referring now to the figures in general, a helmet light is designated 10. The helmet light includes a high intensity illumination light 80, as well as a rearward facing light 90. The helmet light 10 includes an integrated mount 100 for connecting the helmet light to a helmet 5. As shown in FIG. 1, the helmet light 10 may be mounted above the brim 7 of the helmet, or, as shown in FIG. 2, the helmet light may be mounted below the brim of the helmet.

The helmet light 10 includes a forward facing lamp 80 assembly having a bright light source to provide a source of illumination. The helmet light further includes a rearward facing light assembly 90. The rearward light may also provide a source of illumination, however, in the present instance, the rearward light 90 is configured to be an indicator or identification light so that the user can be readily identified from behind. Accordingly, in the present instance, the rearward light 90 is a non-white light having a lower light intensity than the forward lamp 80.

Figure 5:
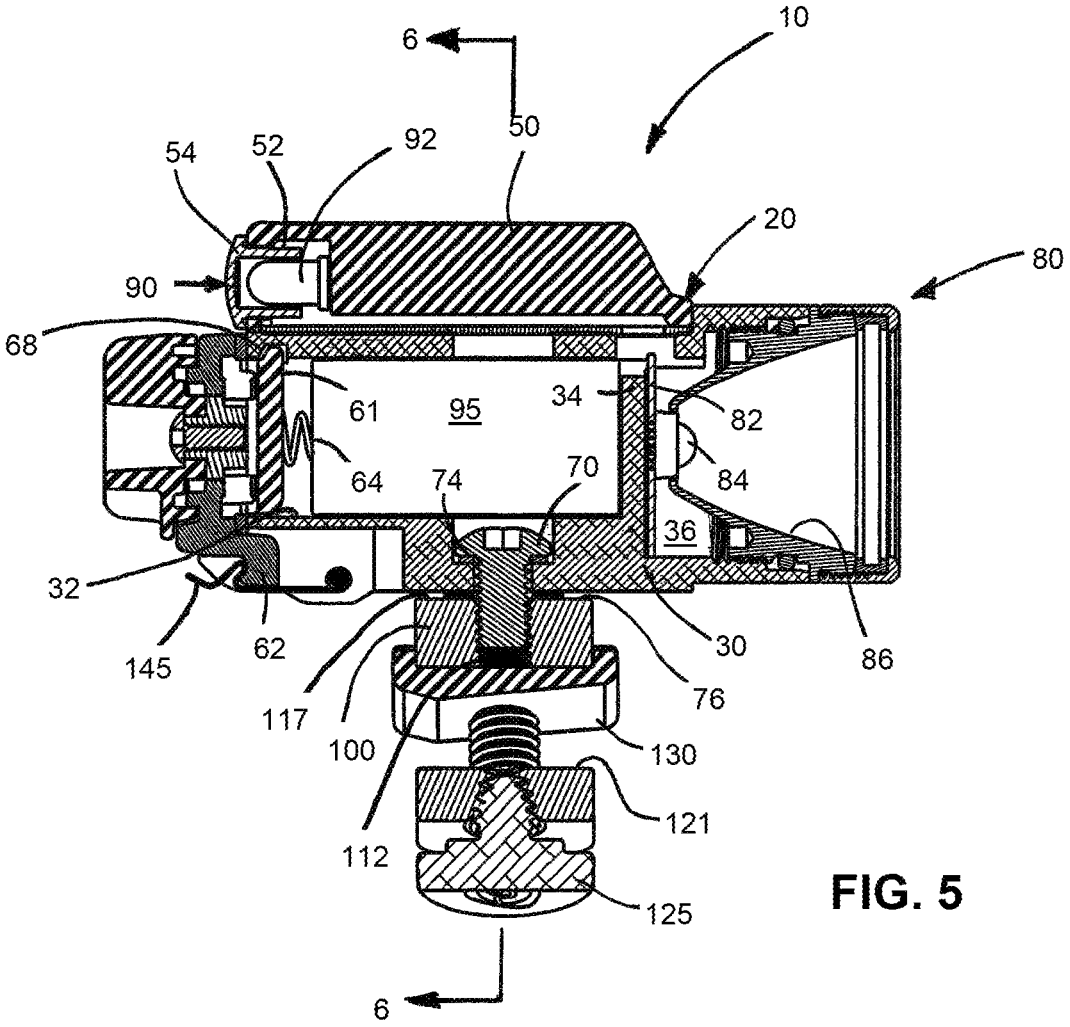
FIG. 5 is a sectional view of the helmet light of FIG. 4*a*, taken along line 5-5.

Referring now to FIG. 5, the features of the helmet light 10 will be described in greater detail. The helmet light 10 includes a housing 20 that includes a barrel 30 and an upper extension 50 housing the rearward light 90. The barrel 30 has an enlarged rearward chamber 32 forming a compartment for receiving the power source, which in the present instance is a pair of single use lithium batteries 95. Alternatively, the power supply may be rechargeable batteries if desired.

The barrel 30 includes a forward wall 34 generally enclosing the forward end of the battery compartment. Forward of the wall 34 is a chamber for housing the forward light assembly 80. A pair of contacts 35 extends through the forward wall 34 and is in circuit with the light assembly 80.

The light assembly 80 is a high intensity light source for providing an illumination light. The light assembly includes a light source, such as a xenon incandescent light bulb, and may include a reflector 86. However, in the present instance, the light source is an LED 84. Specifically, in the present instance, the light source is a high intensity LED, such as an LED providing up to 4,500 candela peak central intensity.

Referring to FIG. 5, the LED 84 is mounted on a PCB assembly 82. The PCB assembly 82 is positioned at the rearward end of the forward chamber 36, so that the PCB assembly abuts the wall 34. In the present instance, the PCB assembly 82 is shaped to conform to the interior of the housing. Additionally, in the present instance, the interior of the forward chamber 36 is non-circular, so that the mating shape of the PCB assembly and the forward chamber operate to locate the position of the LED 84 relative to the housing 20. Specifically, the LED 84 is positioned on the PCB at a predetermined position relative to the perimeter of the PCB. The configuration of the PCB perimeter mates with the interior of the chamber 36 to locate the PCB in a particular orientation relative to the housing. Since the LED is positioned on the PCB at a predetermined location, the mating of the PCB and housing therefore locate the LED at a predetermined location relative to the housing.

As mentioned above, the light assembly 80 includes a reflector 86 to focus the light from the light element 84. A shown in FIG. 5, the reflector 86 includes a threaded portion that threadedly engages an internal threaded portion of the housing. In this way, the mating threads of the reflector and the housing position the focal axis of the reflector at a predetermined location relative to the housing. Accordingly, as described above, the LED 84 is located relative to the housing and the focal axis of the reflector is located relative to the housing, so that the LED is located relative to the focal axis of the reflector.

In addition to the barrel 30, the housing 20 further includes an upper extension 50 for housing the rearward light assembly 90. The upper extension 50 may be integrally formed with the barrel 30, however, in the present instance, the upper extension 50 is a separate element rigidly connected to the top of the barrel 30. For instance, in the present instance, the upper extension is connected to the barrel with a plurality of screws.

The upper extension 50 is shaped similar to a triangular prism extending along the top of the barrel 30. The upper extension is generally hollow, and has a vertical central rib 51 connected to the apex of the upper extension and extending along a substantial portion of the length of the extension. A second PCB 94 extends along the interior of the upper extension and provides an electrical path between the rearward light 92 and the PCB 82 for the forward light assembly 80.

The forward end of the upper extension 50 is closed. The rearward end of the upper extension forms a wall having an aperture. The rearward light element 92 is mounted so that it provides illumination through the aperture 52. Specifically, light element 92 is mounted adjacent the rearward end of the upper extension. In the present instance, the rearward light element 92 is connected to the vertical rib, and abuts the rearward end of the vertical rib. The rearward end of the light is adjacent the aperture 52, and in the present instance, the light element projects into the aperture without projecting from the rearward end of the upper extension. A cover 54 encloses the rearward light within the housing 20. The cover is a plastic translucent element fixedly connected with the upper extension of the housing. In the present instance, the cover has a cylindrical body portion that projects into the aperture 52 and a flared head that abuts the rearward end of the housing extension 50. The flared head is rounded having a low profile so that the cover 52 does not significantly protrude beyond the rearward end of the housing 20.

The rearward light element 92 is an LED. In the present instance, the rearward LED is lower intensity than the forward light element 84. Additionally, the rearward light element 92 may be a different color light element than the forward light element. For instance, in the present instance, the rearward light element is a 470 nm blue LED. By providing light elements of different color, the lights make it easier to determine whether the user is facing toward or away from a person attempting to monitor or locate the user.

The rearward end of the housing 20 comprises a cover or door 60 that encloses the battery compartment 32. The door 60 includes an upper locking tab 61 that engages a slot in the upper wall of the barrel 30, as shown in FIG. 5. The door further includes a lower locking tab 62 that cooperates with a latch 45 on the housing to retain the door on the housing. Specifically, the latch 45 is pivotally connected to the housing, and has a detent that engages the lower locking tab 62 to hold the lower end of the door closed.

Figure 4A:
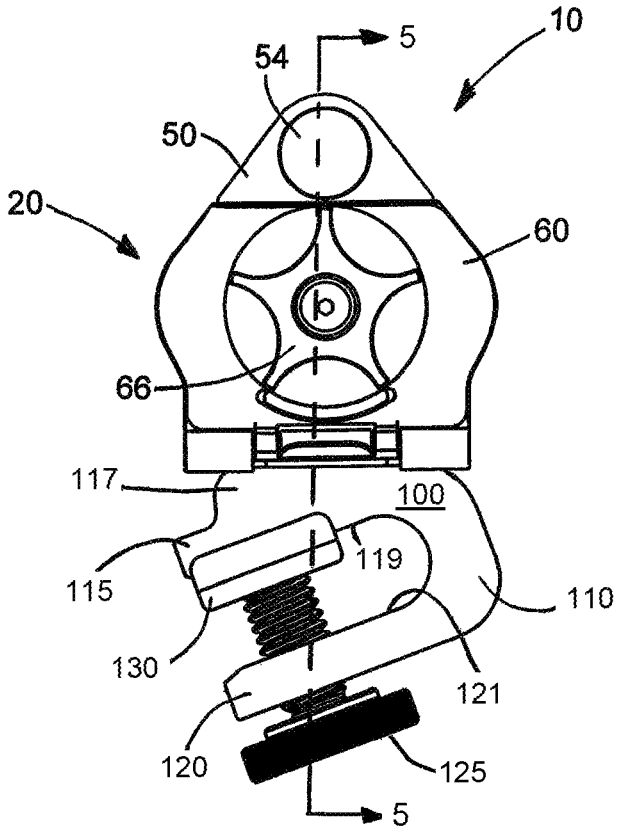
FIG. 4*a* is a rearward view of the helmet light of FIG. 1.

The door 60 further includes a switch 66 for controlling operation of the helmet light 10. As shown in FIG. 4*a*, the switch 66 comprises a rotatable star-shaped actuator. In the present instance, the switch has an actuation surface having a diameter that is approximately the same as the height of the battery compartment to provide an actuation surface that can be readily operated by emergency personnel in their safety equipment. Additionally, the actuation surface of the switch is less than the height and width of the housing. In this way, the housing impedes accidental actuation of the switch.

The switch 66 may be operable to independently control the forward light 84 and the rearward light 92. However, in the present instance, the switch 66 controls the operation of both lights together. Specifically, the door includes a pair of contacts 64 that electrically engage the batteries 95. In a first position, the switch completes the circuit between the two contacts 64, so that the forward and rearward lights are on. In a second position, the switch 66 is open to interrupt the circuit between the two contacts 64 so that the forward and rearward lights are off.

Figure 6:
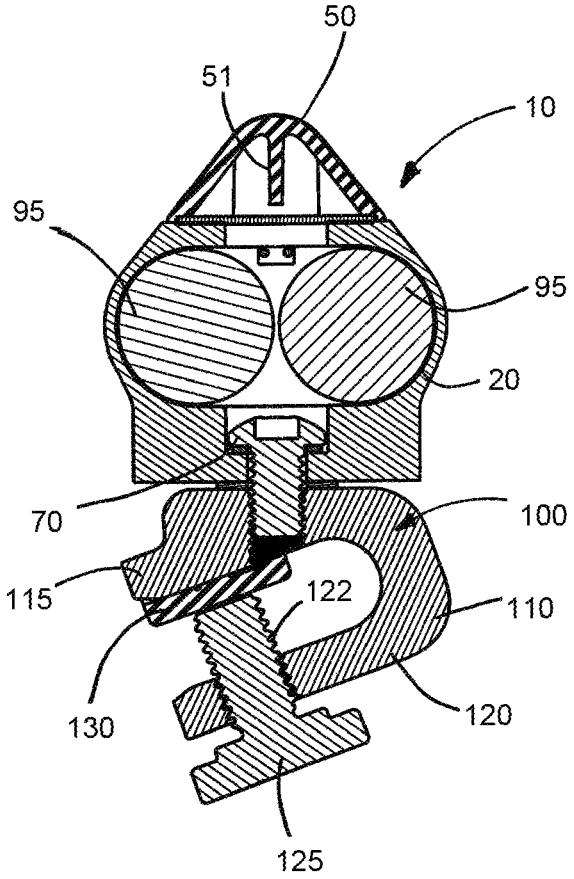
FIG. 6 is a sectional view of the helmet light of FIG. 5 taken along FIG. 6-6.

Referring now to FIGS. 5-6, the details of the integrated helmet mount 100 will be described in greater detail. The helmet mount 100 includes a u-shaped yoke 110 having an upper leg 115 and a lower leg 120. The lower leg 120 is spaced apart from the upper leg to create a gap.

The upper leg 115 includes an exterior surface that forms a base 117. In the present instance, the base 117 is a substantially flat surface disposed substantially parallel to the lower surface of the housing 20. Of course it should be appreciated, that the base may be configured in a variety of circumstances depending on the particular application.

The mount 100 includes a connection element 112 for connecting the mount to the housing 20. In the present instance, the connection element 112 is a female connector, in the form of a threaded socket. The threaded socket extends through the upper leg 115 of the yoke. However, the threaded socket may be a stopped hole that does not extend all the way through the upper leg if desired.

The upper leg 115 includes an interior surface 119 that is formed at an angle to the base surface 117, and is therefore, formed at an angle to the bottom of the housing 20. Similarly, the lower leg 120 includes an interior surface that is substantially parallel to the interior surface 119 of the upper leg.

The lower leg 120 includes a threaded hole 122 for receiving a locking element 125, which in the present instance is a thumbscrew. The threaded hole 122 is disposed at an angle to the lower leg, and in the present instance is normal to the interior surface 121 of the lower leg. The thumbscrew 125 can be threaded into the yoke 110 toward the lower leg to tighten the mount 100 onto a helmet as discussed below. Alternatively, the thumbscrew can be reversely threaded away from the lower leg to loosen the mount.

Referring to FIG. 6, the interior surface of the upper leg is a generally flat surface, and the mount 100 is connected to the housing 20 so that the plane of the interior surface is parallel with the focal axis of the forward light 80. In this way, the focal axis of the forward light is generally parallel to the brim 7 of the helmet 5 when the light is mounted onto the helmet. Although it is desirable to have such an orientation for many helmets, often is it is desirable to adjust the angle of the focal axis upwardly or downwardly from the axis of the brim 7.

To adjust the angle of the focal axis of the light 80 relative to the helmet 5, the mount 100 includes an adjustment element. The adjustment element may be an infinitely adjustable control, however, such a control can introduce an undesirable complication of the device, which could increase the cost, lower reliability or reduce the ease of use of the device. Accordingly, in the present instance, the adjustment element is an adjustment pad 130 that is configured to overlie the interior surface 119 of the upper leg 115.

Figure 7A:
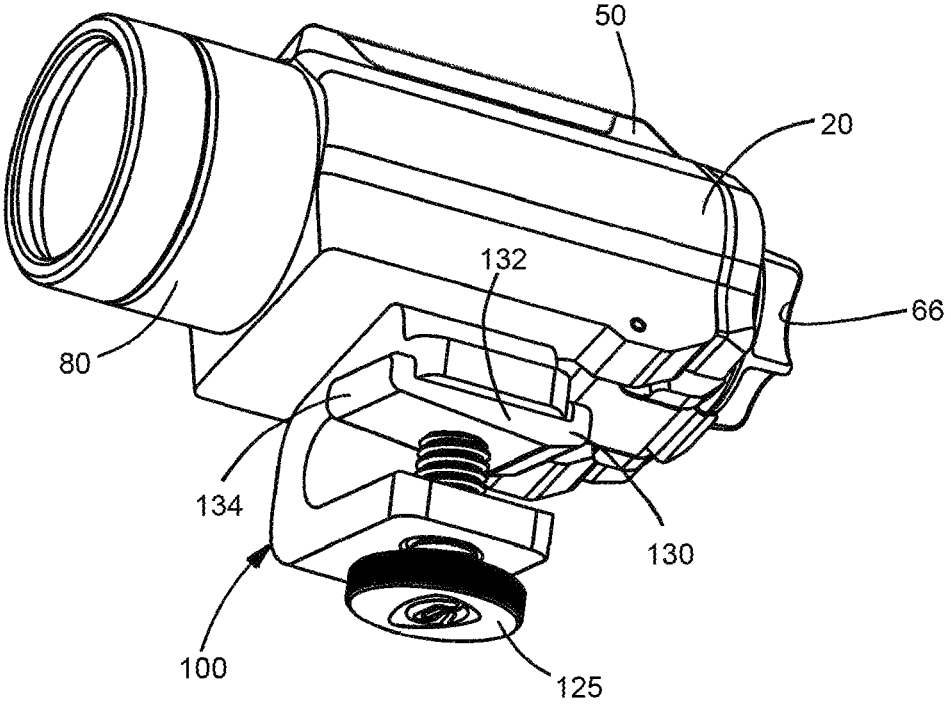
FIG. 7*a* is a perspective view of the helmet light of FIG. 1.
Figure 7B:
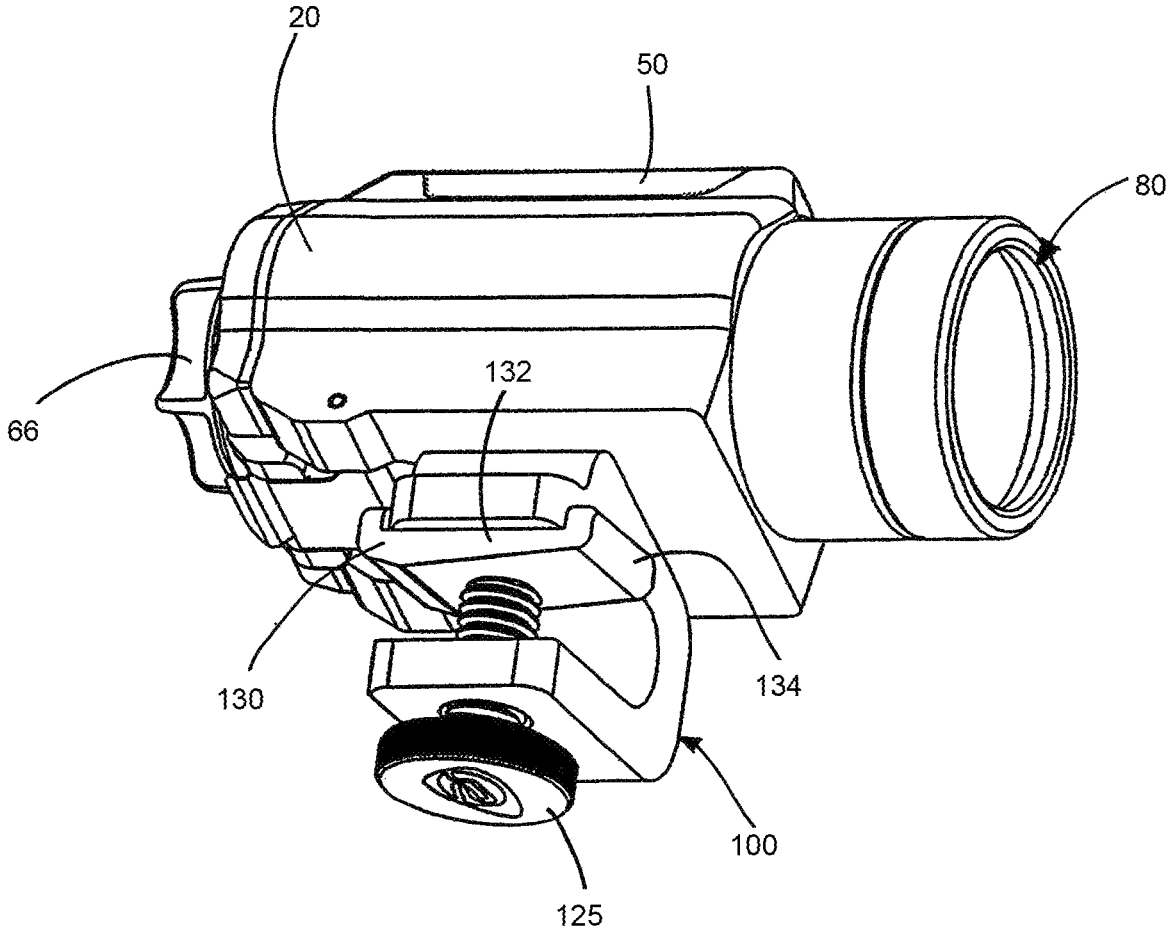
FIG. 7*b* is a perspective view of the helmet light of FIG. 7*a*, with the mount reversed into the second orientation.

The adjustment pad 130 includes an wedge-shaped body 132 having an interior surface configured to overlie the interior surface of the upper leg 119. The outer surface of the body 132 is formed at an angle to the interior surface, thus forming the wedge-shape, as shown in FIG. 7*a*. The adjustment pad 130 may include features for retaining the pad on the upper leg. For example, in the present instance, the pad 130 includes a pair of retention flanges 134. The retention flanges 134 project downward from the edges of the pad and are spaced apart a distance that is approximately the same as the width of the upper leg 115, as shown in FIG. 5. In this way the retention flanges center the pad on the upper leg 115 and orient the angle of the pad along the appropriate axis.

The angle of adjustment depends on the angle of wedge-shaped body 132 and the direction that the pad 130 is mounted onto the upper leg, as mill be discussed further below. Preferably, the pad is formed to provide an angular adjustment of between 3 and 10 degrees. In the present instance, the pad provides an angular adjustment of approximately 5 degrees. Specifically, the body 132 of the pad is configured so that the outer surface of the pad forms a 5-degree angle relative to the interior surface of the upper leg. Accordingly, the outer surface of the pad forms an angle relative to the focal axis of the front light 80 of approximately 5 degrees.

Referring to FIGS. 1,2 and 5, the adjustment that the pad 130 provides depends on the direction that the pad is mounted onto the upper leg, as well as manner in which the light is mounted onto the helmet. Specifically, as shown in FIG. 1, the light 10 is mounted in an over-the-brim orientation on the rightside of brim 7 the helmet 5. In this orientation, the adjustment pad 130 adjusts the beam of light downwardly when the pad is inserted so that the thin edge of the pad is directed forwardly, as shown in FIG. 5. Conversely, when the adjustment pad 130 is reversed so that the thin end of the wedge-shaped body is directed toward the rearward end, the wedge adjusts the beam of light upwardly (in the over-the-brim orientation on the rightside).

In the under-the-brim orientation shown in FIG. 2, the adjustment pad 130 adjusts the beam of light upwardly when the pad is inserted so that the thin end of the wedge-shaped body is directed toward the forward end of the light. Conversely, the adjustment pad adjusts the beam of light downwardly when the pad is inserted to that the thin end of the wedge-shaped body is directed toward the rearward end of the light.

As described above, there are 8 different mounting configurations using the wedge 130: (1) under-the-brim, right side, wedge forward; (2) under-the-brim, right side, wedge rearward; (3) over-the-brim, right side, wedge forward; (4) over-the-brim, right side, wedge rearward; (5) under-the-brim, left side, wedge forward; (6) under-the-brim, left side, wedge rearward; (7) over-the-brim, left side, wedge forward; and (8) over-the-brim, left side, wedge rearward. In the foregoing listing, the term "wedge forward" means that the thin end of the wedge-shaped body is directed toward the forward end of the housing, as shown in FIG. 5. The term "wedge rearward" means that the thin end of the wedge-shaped body is directed toward the rearward end of the housing.

Although there are 8 different mounting configurations using the wedge, the mount needs only 4 variations to provide the 8 mounting configurations. Specifically, the light is configured the same for both (1) under-the-brim, right side, wedge forward and (7) over-the-brim, left side, wedge forward. Similarly, the light is configured the same for the following pairs of mounting configurations:

(2) under-the-brim, right side, wedge rearward and (8) over-the-brim, left side, wedge rearward;

(3) over-the-brim, right side, wedge forward and (5) under-the-brim, left side, wedge forward; and (4) over-the-brim, right side, wedge rearward and (6) under-the-brim, left side, wedge rearward.

The light has two adjustments that provide the four different light configurations, which provides the 8 different mounting configurations. The first adjustment is the pad 130. As discussed above, the pad 130 can be easily removed and reversed so that the pad either faces wedge forward or wedge rearward. Additionally, the mount 100 can be reversed relative to the housing 20 between a first and second orientation, as shown in FIGS. 4*a,b* and 7*a,b*. In the present instance, the connection between the housing 20 and the mount 100 permits reversal of the mount relative to the housing, as discussed further below.

Referring to FIG. 5, the mount 100 is fixedly connected with the housing via a connector 70. In the present instance, the connector 70 constrains motion of the mount relative to the housing to a single plane. Specifically, in the present instance, the connector 70 constrains motion of the mount to rotation about the axis of the connector.

Although a variety of connecting elements can be utilized, in the present instance, the connector is a threaded element, such as a bolt 70. The bolt threadedly engages a threaded socket 112 in the mount 100. Additionally, an adhesive bonds the bolt 70 to the threaded socket 112 to substantially permanently fix the bolt relative to the mount. In the present instance, an adhesive such as Loctite Threadlocker is used. Accordingly, the connector 70 fixes the mount to the housing to prevent relative lateral or vertical displacement of the mount relative to the housing.

Although the connector 70 constrains motion of the mount, in the present instance, the connector is connected to the mount to allow rotation of the mount relative to the housing. Specifically, the bolt 70 is threaded into the connection socket 112 such that a minor gap is created between the mount and the housing. The bolt is then fixed to the socket, such as by adhesive, to prevent the bolt from being displaced relative to the socket. By fixing the bolt relative to the socket, the gap between the mount and the socket is also substantially fixed. By creating a gap between the housing 20 and the mount 100, the mount is able to rotate relative to the housing. Specifically, the mount is able to rotate about the axis of the connector, which, in the present instance, is transverse the focal axis of the lamp 80. Additionally, although the mount is rotatable relative to the housing, the gap between the housing and the mount does not vary substantially as the mount is rotated.

The light 20 further includes one or more elements to help control the rotational displacement of the housing 20 relative to the mount 100. For instance, as shown in FIG. 5, a spacer 76, such as a washer, is disposed between the housing and the mount. The washer has a thickness that is approximately the same as the thickness of the gap between the housing and the mount to provide interference between the housing and the mount. The interference creates frictional force between the mount and the spacer 76 and the spacer and the housing 20 that controls the rotation of the mount relative to the housing. The amount of drag or friction between the housing and the mount is proportional to the amount of torque applied to the bolt 70 when threading the bolt into the mount. In the present instance, the bolt is threaded into the mount to provide sufficient frictional drag to impede rotation of the mount relative to the housing. In this way, the mount 100 is connected so that during use the housing remains substantially fixed relative to the mount to impede accidentally misaligning the light. At the same time, the connection allows the mount to be rotated when the user desires to reconfigure or reorient the light.

In the present instance, the connector 70 is positioned intermediate the ends of the housing. Specifically, the connector is positioned adjacent the midpoint of the housing. Accordingly, less than ¾ the length of the housing projects from the mount, and preferably less than ⅔ the length of the housing projects from the mount. In the present instance, less than approximately ½ the length of the housing projects from the edge of the mount 100. Similarly, referring to FIG. 6, the connector is position intermediate the sides of the housing, and in the present instance is adjacent the midpoint of the width of the housing. Additionally, as can be seen in FIGS. 5-6, the locking thumbscrew 125 is adjacent the midpoint of the width and length of the housing.

As can be seen from the foregoing, the connector 70 attaches to the mount 100 to connect the mount to the housing 20. In the present instance, the connector is threaded into the mount with a predetermined torque. Additionally, a fixative, such as an adhesive fixes the connection between the mount and the connector so that the torque required to disconnect the connector from the mount is substantially greater than the predetermined torque applied to the connector 70 to connect the connector to the mount. In this way, the torque required to rotate the housing relative to the mount is substantially less than the torque required to disconnect the connector from the mount.

Figure 4B:
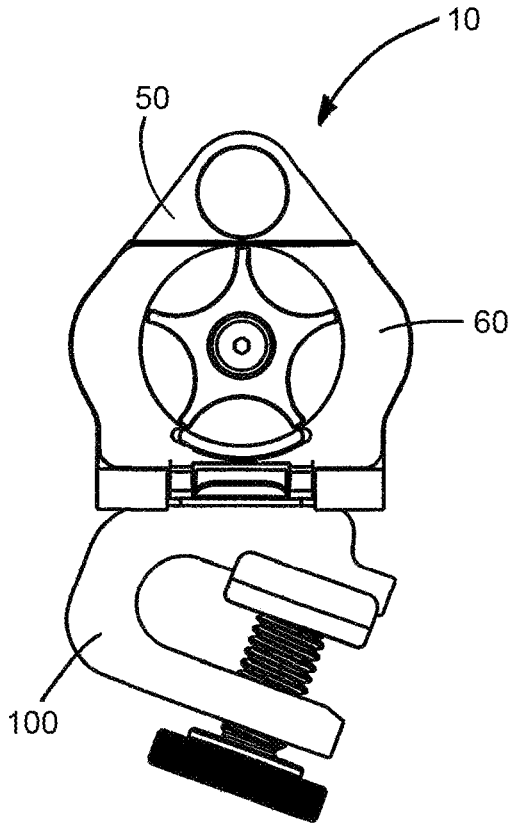
FIG. 4*b* is a rearward view of the helmet light of FIG. 4*a*, with a mount reversed into a second orientation.

Configured as discussed above, the helmet light 10 provides a well-balanced light that is easy to use and easy to mount on a variety of helmets having different brims. Depending on the desired mounting orientation, the user may rotate the mount 180° relative to the housing from the first position shown in FIG. 4*a* to the second position shown in FIG. 4*b*. To mount the helmet light, the thumbscrew 125 is unscrewed to retract the thumbscrew from the mount 100. The mount 100 is then placed onto the brim 7 so that the brim is inserted into the mount between the upper and lower legs 115, 120 of the mount. Preferably, the length of the brim inserted into the mount is greater than the thickness of the brim.

After the brim is inserted into the mount 100, the thumbscrew 125 is rotated to thread the thumbscrew against the brim 7, thereby locking the light 10 onto the helmet. The mount 100 is able to accommodate a number of different brim thicknesses so that the helmet light can be mounted onto a variety of different helmets having different brims. The thumbscrew provides a lock that is infinitely adjustable so that the mount can attach to brims having a thickness range from zero thickness to an upper limit. The upper limit is thickness of the opening between the upper and lower legs 115,120 when no adjustment pad 130 is used. If an adjustment pad is used, the upper limit for the brim thickness is reduced by the thickness of the adjustment pad.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

The invention claimed is:

1. A flashlight mountable on a helmet having a brim, wherein the flashlight comprises:

a housing having a cavity configured to enclose one or more batteries;

a first light source in a forward portion of the housing configured to provide an illumination light projecting forwardly from the housing;

a second light source configured to provide a light projecting rearwardly from the housing;

a helmet mount configured to releasably mount the flashlight to the brim of a helmet, comprising:

a first leg;

a second leg separated from the first leg, wherein the first leg is connected with the second leg such that a slot is formed between the first and second legs;

a first connector comprising first and second ends and a longitudinal axis, wherein the first connector connects the first leg to an exterior surface of the housing, wherein the first end is fixedly connected with one of the housing and the first leg to substantially impede movement of the first end relative to the one of the housing and the first leg, and wherein the second end is connected with the other of the housing and the first leg to provide a connection that substantially impedes:

(i) translatory movement between the second end and the other of the housing and the first leg; and (ii) movement between the second end and the other of the housing and the first leg about first and second orthogonal axes wherein the connection between the second end and the other of the housing and the first leg is configured to allow rotational movement between the second end and the other of the housing and the first leg about a third axis orthogonal to the first and second orthogonal axes, wherein the first, second or third axis is parallel to the longitudinal axis of the first connector;

a second connector for locking onto the brim when the brim is inserted into the slot between the first and second legs.

2. The flashlight of claim 1 wherein the helmet mount is connected to the bottom of the housing adjacent a midpoint of the housing between the front of the housing and the rear of the housing.

3. The flashlight of claim 1 wherein the second connector is a threaded element that threadedly engages the second leg and includes an engagement surface for engaging the brim of the helmet.

4. The flashlight of claim 1 wherein the light produced by the first light has a central axis, and the flashlight comprises an adjustment element for adjusting the angle of the central axis relative to the second axis.

5. The flashlight of claim 1 comprising a wedge removably attached with the helmet mount for adjusting the angle of the flashlight relative to the brim.

6. The flashlight of claim 5 wherein the wedge comprises a locating element for locating the wedge on the second leg.

7. The flashlight of claim 6 wherein the locating element comprises a slot and a leg of the helmet mount fits into the slot to locate the wedge relative to the helmet mount.

8. The flashlight of claim 5 wherein in a first orientation the wedge is configured to provide a first angle of adjustment of the light, and wherein in a second orientation the wedge is configured to provide a second angle of adjustment.

9. The flashlight of claim 1 wherein the first connector projects outwardly from the housing.

10. A flashlight mountable on a helmet having a brim, wherein the flashlight comprises:

a housing having a cavity for enclosing one or more batteries;

a first light source in a forward portion of the housing for providing an illumination light projecting from the forward end of the housing;

a second light source projecting rearwardly from the housing;

a helmet mount configured for releasably mounting the flashlight to the brim of a helmet, wherein the helmet mount comprises:

an opening slot for receiving the brim of the helmet;

a locking screw configured to releasably engage the brim of the helmet when the brim is inserted into the opening slot;

a connector connecting the helmet mount with an exterior surface of the housing so that the helmet mount is rotatable within a plane about a first axis of rotation from a first position to a second position;

wherein the connector is configured to provide a connection that allows the helmet mount to rotate within the plane after the flashlight is mounted on the helmet brim; and wherein the connector is configured to substantially impede movement of the helmet mount relative to the housing in any direction other than rotation about the first axis of rotation;

wherein the connector comprises an axis and the first axis of rotation is parallel with the axis of the connector.

11. The flashlight of claim 10 wherein the helmet mount is connected to the bottom of the housing adjacent a midpoint of the housing between the front of the housing and the rear of the housing.

12. The flashlight of claim 10 wherein the first light source has a focal axis and the second light source is vertically spaced from the focal axis of the first light.

13. The flashlight of claim 10 wherein the light produced by the first light has a central axis, and the flashlight comprises an adjustment element removably connectable with the mount for adjusting the angle of the central axis.

14. The flashlight of claim 10 comprising an adjustment element attached with the helmet mount for adjusting the angle of the flashlight relative to the brim about a second axis.

15. The flashlight of claim 14 wherein the adjustment element comprises a wedge having a locating element for locating the wedge in the opening slot.

16. The flashlight of claim 15 wherein the locating element comprises a slot and a leg of the helmet mount fits into the slot of the locating element to locate the wedge relative to the helmet mount.

17. The flashlight of claim 15 wherein in a first orientation the wedge provides a first angle of adjustment of the light, and wherein in a second orientation the wedge provides a second angle of adjustment.

18. The flashlight of claim 10 wherein the first connector projects outwardly from the housing.

19. A flashlight mountable on a helmet having a brim, wherein the flashlight comprises:

a housing having an opening configured to house one or more batteries;

a first light source in the housing for providing an illumination light projecting forwardly from the housing;

a helmet mount for releasably mounting the housing to the brim of a helmet, comprising:

a first leg;

a second leg separated from the first leg, wherein the first leg connects with the second leg so that a slot is formed between the first and second legs;

a first connector extending into the slot to lock onto the brim when the brim is inserted into the slot;

an axially elongated second connector connecting the helmet mount to the housing;

wherein the second connector comprises a first end extending into the opening in the housing and a second end connected to an opening in the helmet mount;

wherein the second connector is configured to allow rotation of the housing relative to the helmet mount while impeding translatory movement of the housing relative to the helmet mount along the axis of the second connector.

20. The flashlight of claim 19 wherein the housing comprises an exterior surface and the second connector projects from the exterior surface.

21. The flashlight of claim 19 wherein a removeable cap encloses an end of the opening.

22. The flashlight of claim 19 wherein the second connector comprises a first end substantially permanently fixed in the helmet mount to substantially permanently impede motion of the first end relative to the helmet mount.

23. The flashlight of claim 22 wherein the second connector comprises an enlarged head operable to impede translatory displacement of the housing relative to the helmet mount along the axis of the second connector.

24. The flashlight of claim 19 wherein the light produced by the first light has a central axis, and the flashlight comprises an adjustment element removably connectable with the mount for adjusting the angle of the central axis.

* * * * *